United States Patent [19]

Rumens et al.

[11] Patent Number: 4,665,889

[45] Date of Patent: May 19, 1987

[54] STOVE

[75] Inventors: Kurt W. F. Rumens, Seattle; Robert E. Holley, Jr.; Alan Atemboski, both of Kirkland, all of Wash.; Stockton Barnett, Chagrin Falls, Ohio

[73] Assignee: Lopi International, Ltd., Kirkland, Wash.

[21] Appl. No.: 833,997

[22] Filed: Feb. 27, 1986

[51] Int. Cl.[4] ..... F24C 1/14

[52] U.S. Cl. ..... 126/77; 110/214; 126/83; 126/76

[58] Field of Search ..... 126/77, 81, 83, 106, 126/118, 120, 121, 126, 99 D, 99 R, 76, 64, 75, 110 A; 110/210, 211, 214

[56] References Cited

U.S. PATENT DOCUMENTS

| | | | |
|---|---|---|---|
| 197,819 | 12/1877 | Boynton | 126/83 |
| 420,503 | 2/1890 | Weston | 126/77 |
| 1,568,816 | 1/1926 | Elson | 126/121 |
| 2,333,146 | 11/1943 | Beyer | 126/121 |
| 2,396,535 | 3/1946 | Rumery | 126/121 |
| 2,676,583 | 4/1954 | Blumson | 126/76 |
| 2,703,567 | 3/1955 | Manchester et al. | 126/121 |
| 3,538,909 | 11/1970 | Migues | 126/120 |
| 4,060,068 | 11/1977 | Lever et al. | 126/120 |
| 4,154,212 | 5/1979 | Wilkinson | 126/77 |
| 4,177,791 | 12/1979 | Marchant | 126/77 |
| 4,230,091 | 10/1980 | Judge et al. | 126/77 |
| 4,232,651 | 11/1980 | Lind | 126/99 D |
| 4,359,040 | 11/1982 | Martenson | 126/77 |
| 4,404,953 | 9/1983 | Thulman et al. | 126/83 |
| 4,426,992 | 1/1984 | Martenson | 126/77 |
| 4,448,185 | 5/1984 | Buchner et al. | 126/77 |
| 4,483,312 | 11/1984 | Martenson | 126/77 |
| 4,487,195 | 12/1984 | Syme et al. | 126/83 |
| 4,499,889 | 2/1985 | Syme | 126/76 |
| 4,502,462 | 3/1985 | Lawrence | 126/77 |
| 4,510,918 | 4/1985 | Ferguson et al. | 126/77 |
| 4,574,773 | 3/1986 | Moughamian | 126/121 |

*Primary Examiner*—Samuel Scott
*Assistant Examiner*—H. A. Odar
*Attorney, Agent, or Firm*—Seed and Berry

[57] ABSTRACT

Wood burning stove having several features for reducing emissions output and for improving energy efficiency by increasing the supply of oxygen to combustible materials, by increasing the mixing of oxygen with combustible materials, and by lengthening the residence time of combustible materials within the stove. The features include a turbulence-creating means positioned at an upper, front region of the combustion chamber, and a baffle located near the outlet for increasing both turbulence and the pathway of combustible materials exiting the stove.

6 Claims, 3 Drawing Figures

STOVE

TECHNICAL FIELD The present invention relates in general to solid fuel burning stoves, and more specifically, to wood burning stoves in which efficiency is increased and emissions decreased without the need for a catalytic oxidation element.

BACKGROUND ART

Over the past two decades, the use of wood burning stoves has become increasingly popular in homes and businesses, both rural and urban. However, this increased use of wood burning stoves has created pollution problems because of the hazardous emissions released from such stoves. Various law-making bodies have responded to this problem by mandating that stoves burn more cleanly. One solution developed by the stove industry has been the development of stoves which include a multi-chambered catalytic oxidation element which aids in secondary combustion of particulate matter before it exits the stove. Such catalytic stoves do decrease emissions output; however, they require periodic replacement of the catalytic body at a substantial cost to the stove owner.

DISCLOSURE OF THE INVENTION

With some of the foregoing problems in mind, one object of the present invention is a wood burning stove which burns more efficiently and thus produces fewer emissions.

A further object of the present invention is a stove which decreases emissions and increases secondary combustion by the combination of creating more turbulence within the secondary combustion zone, ensuring an adequate supply of preheated fresh air to the primary and secondary combustion zones, and increasing the time spent by combustible material within the combustion chamber.

Another object of the present invention is to increase fuel economy and decrease emissions of a wood burning stove without the need for a catalytic oxidation element.

The foregoing objects are achieved in the present invention by providing means for extending residence time of combustible material within the secondary combustion zone of the stove, for better mixing of the combustible material in the secondary combustion zone, and for introducing fresh preheated air directly into the primary and secondary combustion zones. The invention includes a means for inducing turbulence in a forward portion of the secondary combustion zone and at least one aperture for a flow of fresh preheated air into the secondary combustion zone. The present invention also includes a baffle in a rear region of the secondary combustion zone which has a two-fold function of forcing combustible material to travel farther before exiting the stove, thus increasing residence time, and of inducing further turbulence in the secondary combustion zone. The combination of these features produces more complete combustion, greater heat output and fewer emissions.

In a preferred embodiment, the present invention utilizes a stove which includes a casing, surrounding a combustion chamber, which in turn is divided into primary and secondary combustion zones by a partition. Air moves from the primary combustion zone into the secondary combustion zone via a convection passage. The partition also has a bypass aperture, closed by a bypass damper, located toward the rear wall of the casing.

A front wall of the casing includes a door having a glass window. The partition extends from a rear wall of the casing toward the door and front wall. An air inlet is located in a floor of the casing. Fresh air flows through the inlet into the stove. The fresh air is channeled through at least one preheat duct and toward an upper region of the combustion chamber. After it exits the preheat duct, the fresh air enters a transverse duct containing at least one downwardly disposed aperture. The air travels through the downwardly disposed aperture, where it flows past a deflector attached to the ducts. The deflector channels the airflow down past the glass window and also directly into the primary combustion zone.

The transverse duct also has at least one rearwardly disposed aperture through which fresh air travels directly into the secondary combustion zone, thus ensuring fresh oxygen for more complete secondary combustion.

The stove also includes an outlet through which air exits the secondary combustion zone and the stove. A baffle extends downward into the secondary combustion zone from the outlet to increase turbulence of the air and to increase the time spent by combustible material within the secondary combustion zone. The baffle includes an appendage projecting toward the rear wall of the casing to further increase time and turbulence.

The convection passage is defined by the partition, the preheat and transverse ducts, and the deflector. The partition includes an appendage projecting into the convection passage to increase turbulence. The convection passage converges in the direction of the secondary combustion chamber.

BEST MODE FOR CARRYING OUT THE INVENTION

Figure 1:
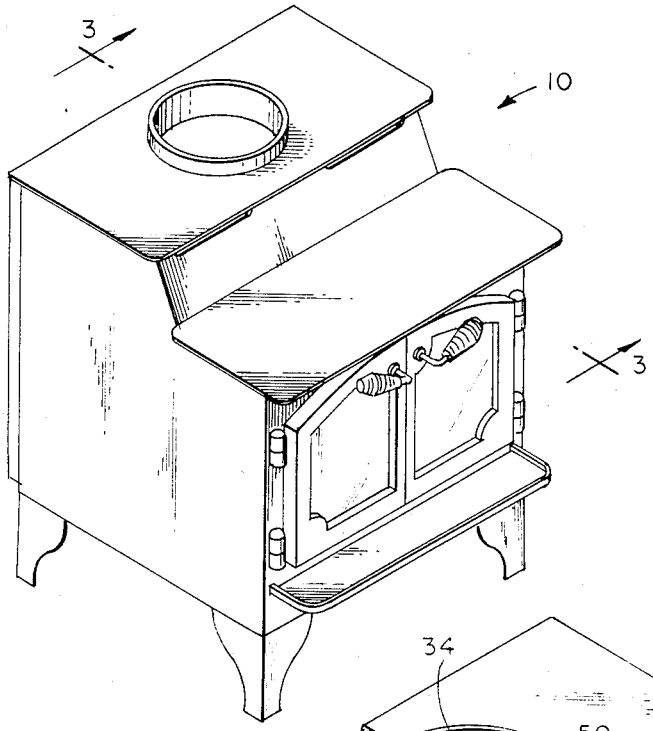
FIG. 1 is an exterior isometric view of the stove of this invention.
Figure 2:
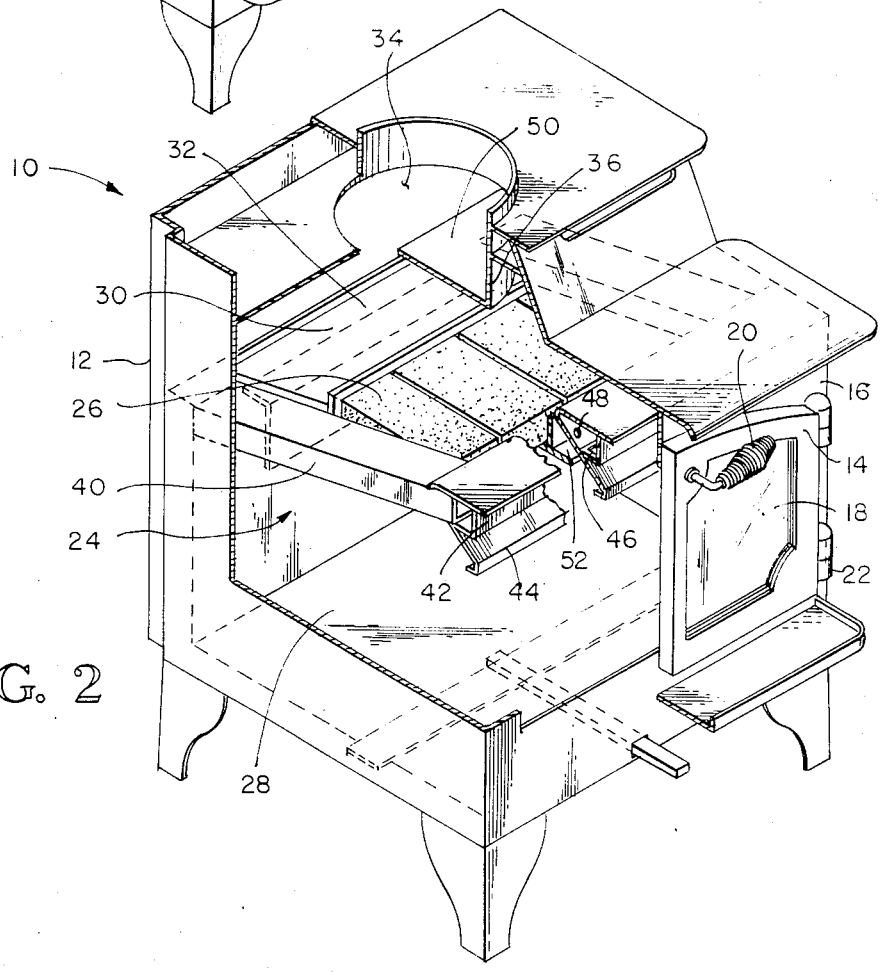
FIG. 2 is a partial cutaway isometric view exposing the internal components of the present invention.

The present invention is an improvement to a wood burning stove 10, the exterior of which is shown in FIG. 1. Referring to FIG. 2, the stove 10 of the present invention includes a casing 12 constructed of metal or other noncombustible material. A door 14 is located in a front wall 16 of the casing. The door includes a glass window 18 which allows an operator to view the fire, both for aesthetic enjoyment and to determine when additional fuel is needed. The door may have a handle 20 to facilitate opening and closing, and may be fastened to the casing by hinges 22.

The casing surrounds a combustion chamber 24 which in turn is divided by partition 26 into a primary combustion zone 28, located below the partition, and a secondary combustion zone 30, located above the partition.

The partition is attached to the casing and extends toward the front wall. A bypass aperture 32 is located in the partition toward a rear wall of the casing and is closed by a movable bypass damper 33.

The stove includes an outlet 34 located in an upper region of the casing. A baffle 36 which acts as an obstruction projects downward from the outlet into the secondary combustion zone.

The floor of the casing includes an air inlet 38 through which fresh air enters the stove. The stove also includes a pair of transversely spaced preheat ducts 40 and a transverse duct 42. Attached to the ducts is a deflector 44. The transverse duct has at least one downwardly disposed aperture 46 and at least one rearwardly disposed aperture 48.

The baffle 36 extending downward from the outlet into the secondary combustion chamber has an appendage 50 extending from the baffle toward the rear wall of the casing. Similarly, the partition includes an appendage 52 extending from a lower portion thereof toward the front wall of the casing. The deflector also has an appendage 53 projecting toward the rear of the casing.

Figure 3:
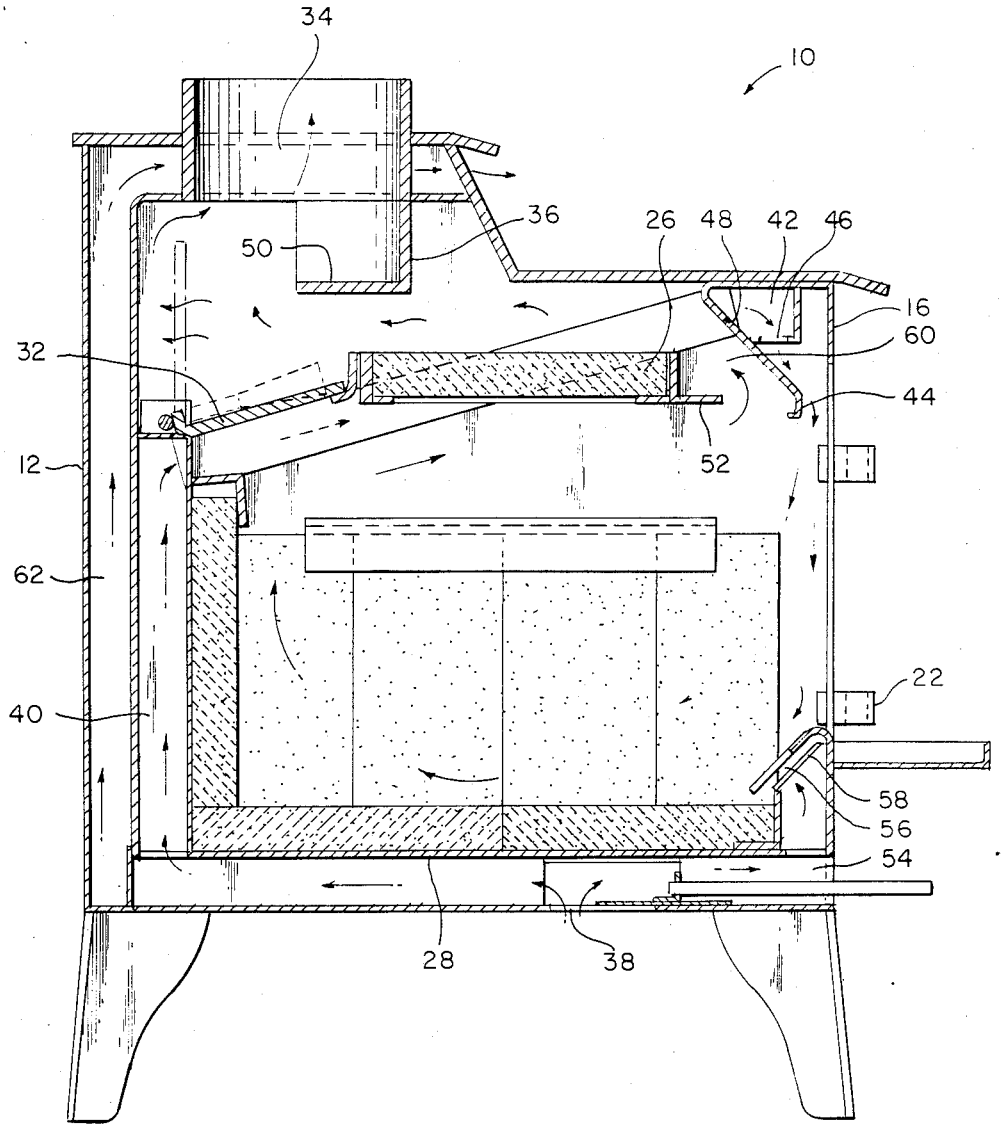
FIG. 3 is a vertical cross-sectional view taken along line 3—3, as shown in FIG. 1.

FIG. 3 illustrates the flow of air through the stove during combustion. Air enters the stove through an inlet 38. The air is channeled through the preheat ducts 40 so that it may be heated before being introduced to the combustion chamber.

A small amount of cold incoming air is channeled directly into the combustion zone through a startup duct 54 and through startup inlet 56 positioned in a lower region of the casing. As the fire increases in temperature, most of the incoming air is channeled naturally into and through the preheat ducts.

After the air flows through the preheat ducts, it enters a transverse duct 42. The air flows through at least one downwardly disposed aperture in the transverse duct toward the primary combustion zone.

A deflector 44 channels part of the airflow down past the glass portion of the door so as to clean the glass portion and prevent a buildup of smoke stains or soot thereon. The deflector also channels a portion of the incoming preheated air directly into the primary combustion zone, thus feeding the fire with fresh oxygen.

Hot air laden with smoke and partially combusted material rises in the rear portion of the primary combustion zone. If the stove is relatively cold, for example, when a fire is being built, the bypass aperture 32 may be opened to allow the smokey air to exit the stove from the outlet 34 rather than through the door, which may be open while the operator adds fuel and builds the fire.

When the bypass damper is in a closed position, as shown in FIG. 3, the hot, smokey air is channeled by the partition toward a front region of the primary combustion zone. The air then enters a convection passage 60 connecting the primary and secondary combustion zones. Once in the secondary combustion zone, the air flows toward the rear wall of the casing and finally up through the outlet 34.

The stove of the present invention includes features which achieve a greater heat output as well as a decreased emissions level. Both goals are reached by increasing the turbulence of the air which contains combustible material, and by increasing the length of time that the combustible material remains in the respective combustion zones.

The features mentioned above include an appendage 52 extending from a lower portion of the partition into the convection passage 60. This appendage acts to increase the turbulence of the air as it moves from the primary combustion zone into the secondary combustion zone. The operation of this appendage is two-fold: it forces part of the smokey air to reenter the circulation of the primary combustion zone so that the particles, gases, and oils in the air may undergo further combustion in the primary zone. The appendage also increases turbulence within the convection passage and within the secondary combustion zone, thus preventing the smokey air from exiting the stove prematurely. Because the smokey air is retained in the secondary combustion zone for a longer period of time, it undergoes more complete oxidation, thus reducing the level of combustible material leaving the stove, as well as increasing the energy output of the fuel.

The deflector appendage 53 helps to channel air to the internal region of the primary combustion zone, and further helps to increase turbulence and mixing of fresh air and smoky air before it enters the convection passage and the secondary combustion zone.

The transverse duct has at least one rearwardly disposed aperture 48 through which preheated fresh air may enter the secondary combustion zone directly. This fresh air helps to increase turbulence and also to ensure complete combustion in the secondary zone.

The convection passage 60 is defined by the partition 26 with its appendage 52, the preheat and transverse ducts 40 and 42, respectively, and the deflector 44. As shown in FIG. 3, the convection passage converges in the direction of the secondary combustion zone. This feature helps to increase turbulence of the smokey air, particularly when coupled with the fresh air entering the secondary combustion zone via the rearwardly disposed aperture in the transverse duct.

Another feature which lengthens the time of combustion and increases turbulence is an appendage 15 projecting from the outlet baffle 36 toward the rear wall of the casing. The air is forced to flow around the baffle and appendage and thus remains in the hot secondary combustion zone for an increased period of time.

As illustrated in FIG. 3, the stove of the present invention may be used with a blower system by which air is channeled through a heating duct 62 before reentering the room or area being heated. The appendage 50 extending from the baffle helps to ensure greater heat exchange from the air in the secondary combustion to air in the heating duct by forcing hot air to flow toward the rear wall of the casing before exiting the stove.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A woodburning stove, comprising:

a casing surrounding a combustion chamber; a door in a front wall of the casing; air inlet means located in the casing; a partition attached to the casing and dividing the combustion chamber into a primary combustion zone below the partition and a secondary combustion zone above the partition, wherein air moves from the primary combustion zone into the secondary combustion zone through a convection passage located in a forward region of the casing;

a pair of transversely spaced preheat ducts, each of which runs from the air inlet means along a side wall of the casing toward a back wall of the casing, up the back wall of the casing toward the partition, and along the partition toward the front wall of the casing, terminating at an upper, forward region of the casing and connected to each other by a transverse duct wherein air enters and is heated in the preheat ducts, where it expands and increases in velocity as it moves toward the transverse duct;

means for supplying preheated fresh air directly to the primary combustion zone from the transverse duct, means for supplying preheated fresh air directed to the secondary combustion zone from the transverse duct;

a partition appendage attached to the partition and projecting into the convection passage; and a baffle attached to the casing near the outlet and projecting into the secondary combustion zone so that air in the secondary combustion zone must flow around the baffle before flowing through the outlet, whereby the partition appendage and the baffle together cause air to remain in the secondary zone for an increased period of time, and to undergo enhanced turbulence.

2. The stove of claim 1 wherein the convection passage converges in the direction of the secondary combustion zone.

3. The stove of claim 1 wherein the partition appendage is a shelf projecting from a lower portion of the partition and disposed substantially perpendicular thereto.

4. The stove of claim 1, further comprising a deflector attached to the transverse duct and forming a forward wall of the convection passage.

5. The stove of claim 4 wherein the baffle includes a baffle appendage attached to the baffle and projecting toward a rear wall of the casing, to further increase the residence time and turbulence of the air in the secondary combustion zone.

6. The stove of claim 4 wherein the partition, partition appendage, transverse duct and deflector are disposed to create a convection passage which converges in the direction of the secondary combustion zone.

* * * * *